US005988156A

United States Patent [19]

Schmid et al.

[11] Patent Number: 5,988,156

[45] Date of Patent: Nov. 23, 1999

[54] FLUID FUEL SPRAY BURNER FOR A HEATER

[75] Inventors: Hans-Jürgen Schmid, Ludwigsburg; Fritz Mohring, Ostfildern; Adolf Schodt, Esslingen; Helmut Keinert, Nürtingen, all of Germany

[73] Assignee: J. Eberspächer GmbH and Co., Esslingen, Germany

[21] Appl. No.: 08/860,839

[22] PCT Filed: Dec. 1, 1995

[86] PCT No.: PCT/DE95/01726

§ 371 Date: Jun. 12, 1997

§ 102(e) Date: Jun. 12, 1997

[87] PCT Pub. No.: WO96/20372

PCT Pub. Date: Jul. 4, 1996

[30] Foreign Application Priority Data

Dec. 24, 1994 [DE] Germany ..... 94 20 677 U
Sep. 20, 1995 [DE] Germany ..... 195 34 866

[51] Int. Cl.[6] ..... F24H 3/02

[52] U.S. Cl. ..... 126/110 B; 126/110 D; 237/12.3 C; 237/32

[58] Field of Search ..... 126/110 D, 110 R, 126/110 B, 116 R; 237/12.3 C, 12.3 A; 431/89, 90, 22, 38, 350, 354; 432/222, 223, 224

[56] References Cited

U.S. PATENT DOCUMENTS

| | | | |
|---|---|---|---|
| 3,648,681 | 3/1972 | Stump | 126/110 B |
| 4,718,602 | 1/1988 | Beck et al. | 126/110 B |
| 4,998,878 | 3/1991 | Gruber | 431/89 |

FOREIGN PATENT DOCUMENTS

| | | | |
|---|---|---|---|
| 2248484 | 5/1973 | Germany | 126/110 B |

*Primary Examiner*—James C. Yeung
*Attorney, Agent, or Firm*—McGlew and Tuttle, P.C.

[57] ABSTRACT

A fluid spray burner for a heater having a nozzle block which supports a spray nozzle and to which fuel can be fed from a fuel line via a fuel pump. A fuel pump is integrated in the burner housing, and in particular to a radial carrier plate thereof.

22 Claims, 4 Drawing Sheets

FLUID FUEL SPRAY BURNER FOR A HEATER

FIELD OF THE INVENTION

The present invention pertains to an atomizing burner for liquid fuel for a heater with a burner nozzle assembly, which carries an atomizing nozzle and to which fuel can be fed from a fuel line via a fuel pump.

BACKGROUND OF THE INVENTION

An atomizing burner of the above-described type, in which the burner nozzle assembly and the fuel pump is, together with other components, a preassembled structural unit, which can be fastened to a flange of the burner housing, has been known from DE 35 36 170 C2. A comparatively compact design of an atomizing burner and simplified assembly are achieved as a result.

SUMMARY AND OBJECTS OF THE INVENTION

The object of the present invention is to provide an atomizing burner of the type described in the introduction, which has an even simpler design than the above-mentioned burner and which provides, in particular, an atomizing burner which has a very simple and compact design and is composed of a small number of individual parts and connection parts.

According to the invention, an atomizing burner is provided for liquid fuel for a heater, with a burner nozzle assembly, which carries an atomizing nozzle and to which fuel can be fed from a fuel line via a fuel pump. The fuel pump is integrated in the burner housing.

The burner housing may have a radial support plate, in which the fuel pump is provided. The support plate preferably has a central base, which has, on one axial side, a first recess, in which the gear assembly of the gear-driven fuel pump is arranged. A second recess is preferably arranged on another axial side of the central base, and the coupling of the fuel pump is preferably arranged in the second recess, wherein the coupling is in drive connection with the driving pinion of the gear-driven fuel pump via a drive shaft extending in an axial passage of the support plate.

The essence of the present invention is that the fuel pump is integrated in the burner housing, and the fuel pump housing is provided in a radial support plate of the burner housing in an advantageous variant of the present invention.

The support plate has a central base, which has a first recess on one axial side, and the gear assembly of the gear-driven fuel pump is arranged in the first recess.

A second recess, in which the coupling between the fuel pump and the motor is arranged, is provided on the other axial side of the support plate, and the coupling is in drive connection with the driving pinion of the gear-driven fuel pump via a drive shaft extending in an axial passage of the support plate.

The burner nozzle assembly is preferably fastened to one axial side of the support plate by fastening screws distributed over the circumference, and the burner nozzle assembly covers the first recess in a sealed manner. Consequently, the burner nozzle assembly forms with its front side the cover of the first recess, in which the fuel is pressurized by the fuel pump.

The drive motor of the fuel pump is in drive connection with the coupling, and the drive motor is fastened on the other axial side of the support plate, covering the second recess, by additional fastening screws distributed over the circumference.

The drive shaft between the coupling and the gear assembly of the gear-driven fuel pump is mounted in the support plate by means of a slide bearing, with a bush made of bearing material being provided as the slide bearing.

The drive shaft has, preferably on the coupling side, a rotary shaft seal, especially a "Simmer" ring, which is arranged in an annular recess of the support plate.

A channel is provided in the support plate between the rotary shaft seal and the first recess, essentially axially parallel and eccentrically, and the channel brings about a pressure equalization, cools the rotary shaft seal and the slide bearing and supplies same with lubricant, i.e., with diesel fuel.

Furthermore, a fuel feed line to the first recess and a fuel return line are provided in the support plate, with the connection points being located at the radially outermost point of the support plate, preferably in a cylindrical housing jacket of a burner housing.

In a special variant of the present invention, the burner housing is a cast part, especially a diecast part or a precision cast part, which may optionally be subjected to mechanical finishing.

The fuel pump may have an overpressure protection means, especially a pressure relief valve, which establishes a short circuit between the suction line and the return line if the return line is closed.

An especially advantageous design variant is characterized in that (with the above-mentioned overpressure protection means being eliminated), the fuel pump is designed for a single-strand operation and has a plug in the second jacket opening (or in an outer extension tube leading to same), wherein the first line section is connected to the second line section via a line branch. Excess fuel is consequently returned to the first line section rather than being discharged to the outside.

As an alternative, the plug may also be arranged in the first jacket opening or in a tube extension herefrom, in which case the fuel connection is via the second jacket opening.

The line branch is, in particular, a parallel hole to the second line section and is closed to the outside with the plug. The outer fuel return line of the first design variant joining the second jacket opening is consequently absent in the latter variant and it contributes to the simplification and the reduction of the cost of the atomizing burner. The burner is rather operated with a single outer strand (the fuel supply).

An especially advantageous variant of an atomizing burner of the single-strand variant is characterized in that the plug is a vent screw in the jacket opening (or in an extension tube). The plug can thus be screwed on completely or partially to vent the fuel pump, as a result of which simple venting becomes possible. A design similar to that used in the case of brake vent screws in motor vehicles is conceivable.

The number of components is reduced and the fuel line is reduced to a minimum by the present invention compared with prior-art atomizing burners, aside from external connections, the components are arranged exclusively in the burner housing and in the support plate of the burner housing. Contrary to prior-art arrangements, the separate pump housing is eliminated. There are no sealing points for the suction line and return line between the burner housing and the pump housing, nor is there any additional fuel deflection in the burner housing and the pump housing, and the overall length is shorter, because the burner housing and the pump housing are integrated.

As can be seen, the present invention leads to a burner housing with the fuel pump housing as one structural unit. Since prior-art burners provide separate parts for these, all connection means along with the corresponding seals are also eliminated according to the present invention. The overall length decreases further due to the elimination of prior-art housing flanges. The fuel is fed directly into the immediate vicinity of the fuel pump with a single deflection in a crescent-shaped deflecting section, and the fuel is fed in axially.

The present invention will be explained in greater detail below on the basis of an exemplary embodiment, with reference to the drawings attached.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
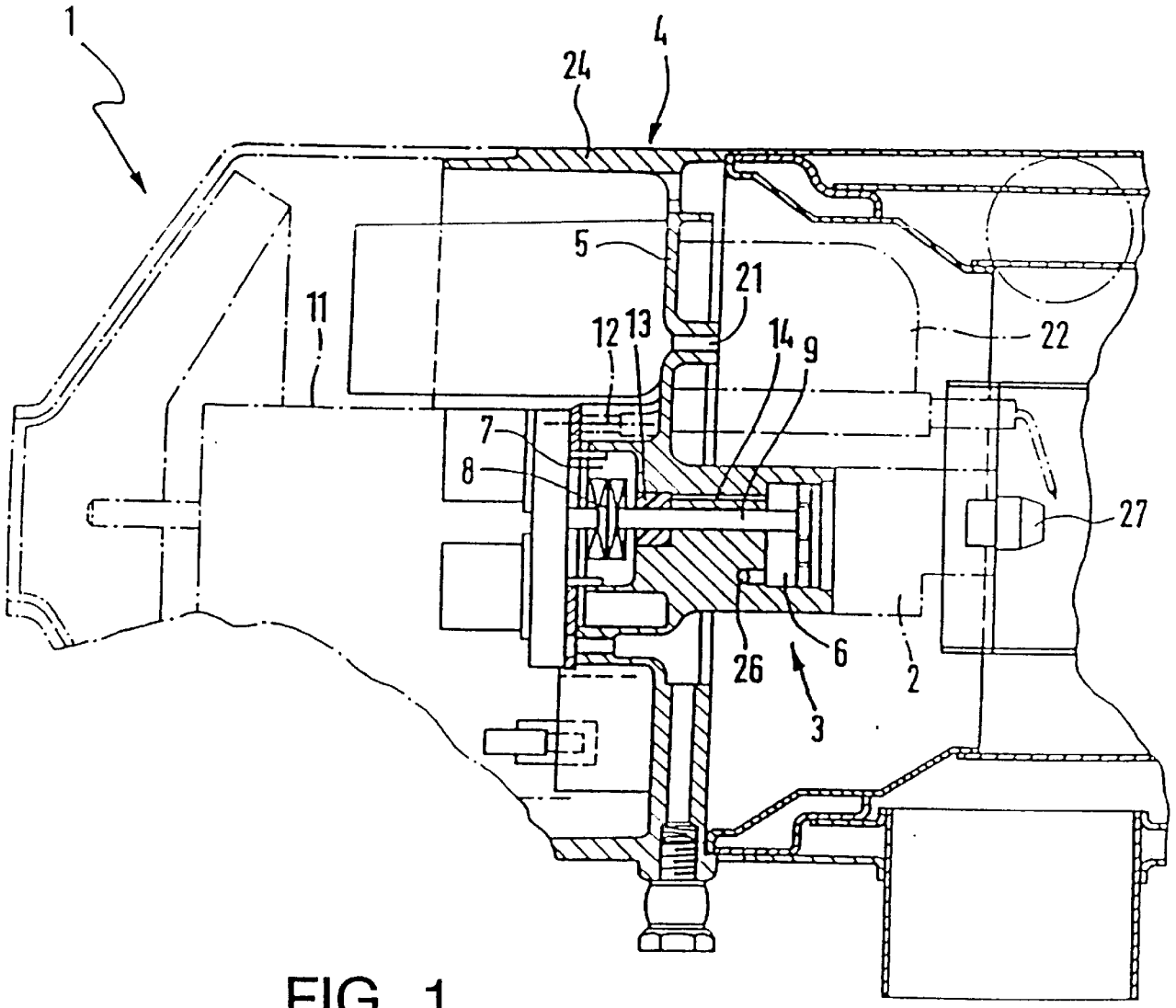
FIG. 1 is a schematic axial sectional view of an atomizing burner in the area of the burner housing.

Referring to the drawings in particular, the invention comprises an atomizing burner 1 for liquid diesel fuel comprises, for supplying a heater, a burner nozzle assembly 2 with atomizing nozzle 27, which is fastened centrally on a radially extending support plate 5 of a burner housing 4 via circumferentially distributed fastening screws.

The fuel pump 3 supplying the burner nozzle assembly 2 with fuel is integrated in the support plate 5, as will be described more specifically below. The fuel pump is driven via a drive shaft 9 by a drive motor 11, wherein a coupling 8 is arranged between them. All the above-mentioned components are located on the axis of the burner housing 4, which has a cylindrical housing jacket 24.

The fuel is supplied to the fuel pump 3 integrated within the support plate 5 through an external fuel line, not shown, which is connected to a first jacket opening 15. The first jacket opening 15 is in connection with the fuel pump 3 via a fuel feed line 25 located within the support plate.

The support plate 5, which is a one-piece cast part together with the cylindrical housing jacket 24, has fastening points 21 for fastening an ignition spark generator 22 and for a fuel pressure regulator 20. Additional threaded holes and cored holes for tapping fastening screws 12 are provided for flanging on the drive motor 11.

The support plate 5 has, in particular, a central base, which has a first, central gear recess 6 on one axial side, to the right in FIG. 1. The gear assembly 34 of the gear-driven fuel pump is located in the first recess. The driving pinion of the gear assembly 34 is located at the right of the drive shaft 9 according to FIG. 1, and the drive shaft 9 extends through an axial passage of the support plate 5 and is mounted in a slide bearing formed by a bearing bush in the axial passage.

On the other axial side of the central base of the support plate 5, i.e., on the left-hand side according to FIG. 1, there is a second or coupling recess 7, in which the coupling 8, which transmits the driving force from the drive motor 11 to the gear assembly of the fuel pump via the drive shaft 9, is located.

In an annular recess of the support plate 5 in the area of the coupling 8, there is a rotary shaft seal 13, which is especially a "Simmer" ring, which is mounted in the recess. The rotary shaft seal 13 is in connection via an essentially axially parallel, eccentric channel 14 with the first recess 6, in which the gear assembly of the fuel pump is arranged. The channel 14 ensures optimal lubrication and cooling of the slide bearing as well as of the rotary shaft seal 13 during the operation of the atomizing burner 1.

Figure 2:
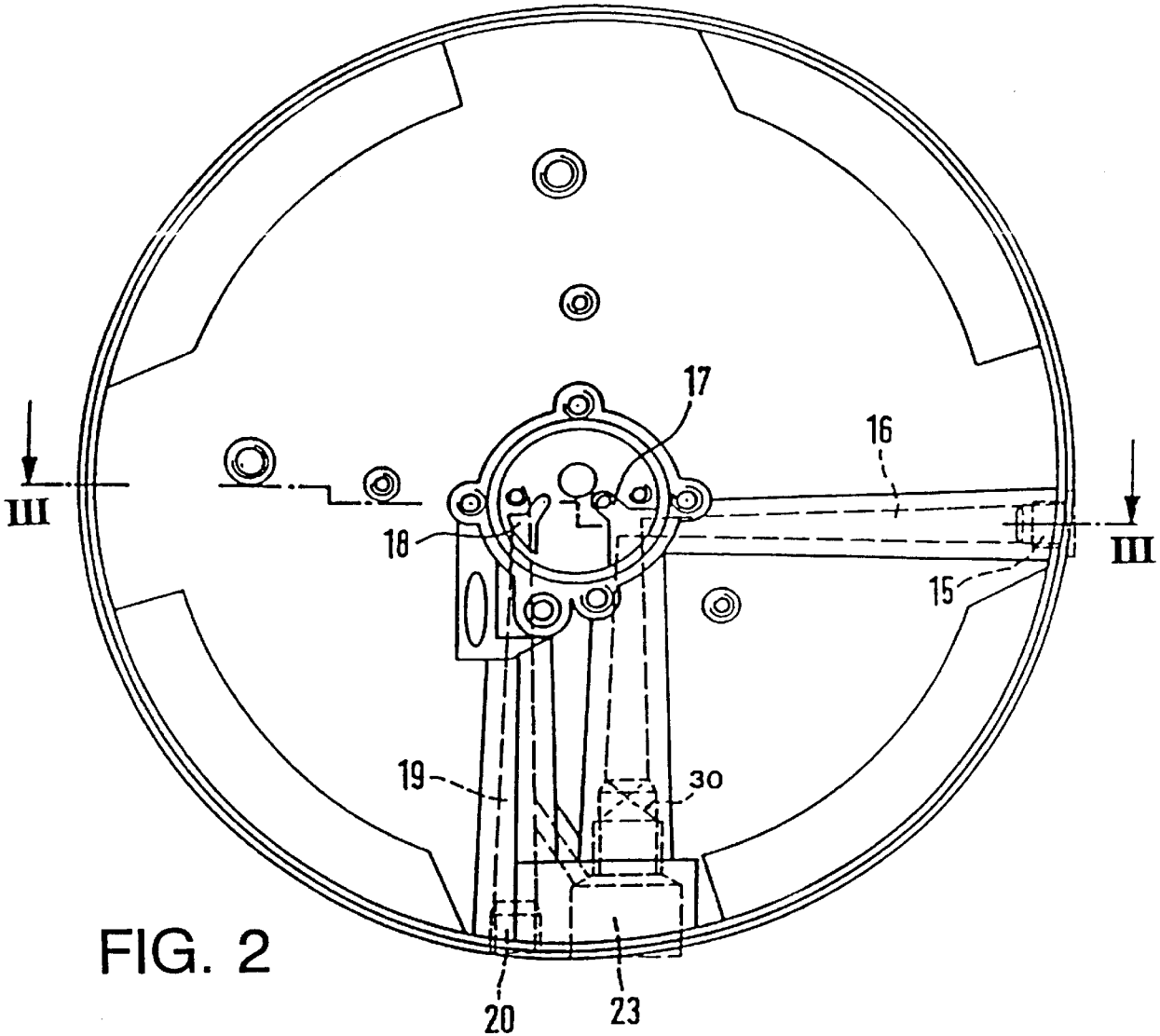
FIG. 2 is a front view of the burner housing according to FIG. 1, viewed from the right.
Figure 3:
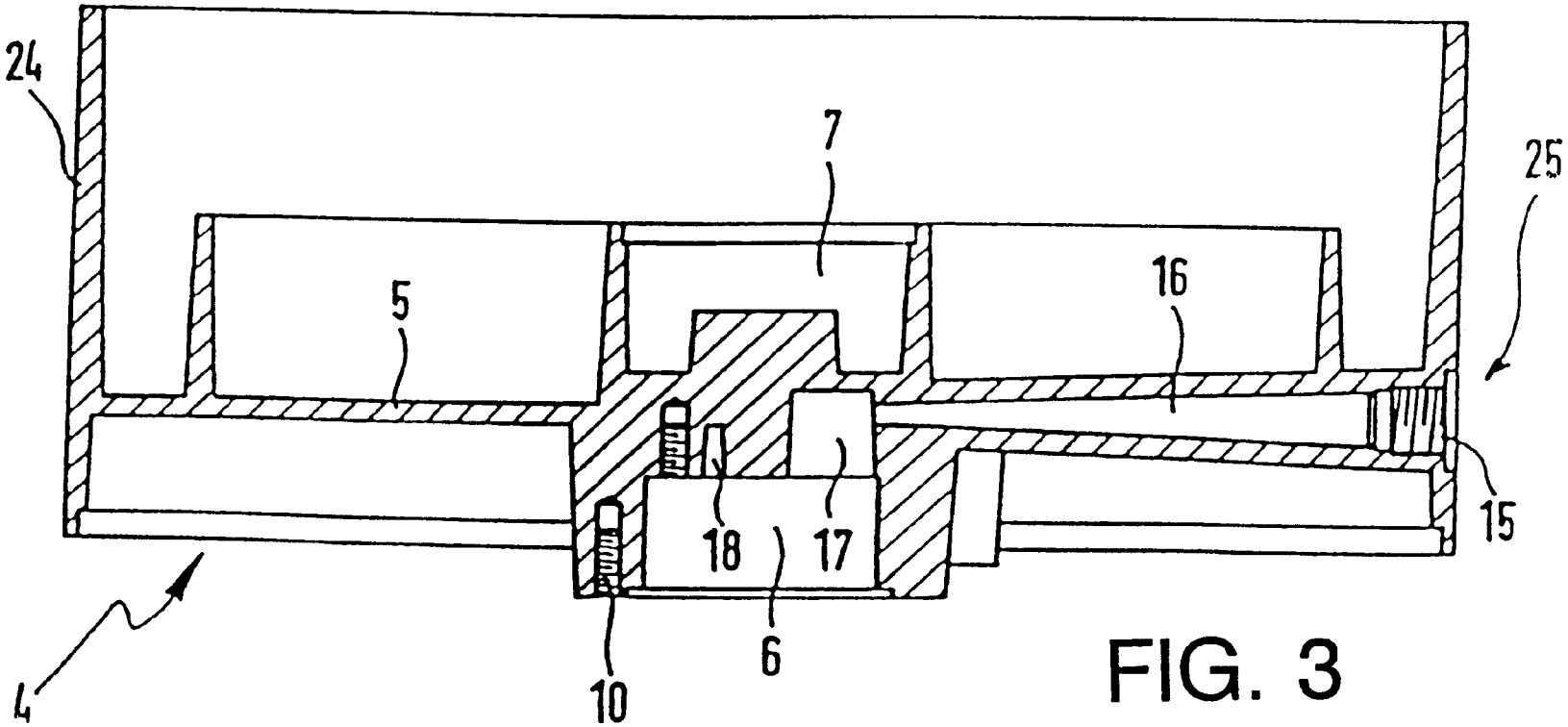
FIG. 3 is a sectional view through the burner housing according to FIG. 2 along line III—III.

The fuel feed line 25 located inside the support plate comprises, as is shown especially by FIGS. 2 and 3, a radial, first line section 16, which passes over at a radially inner point into a first, crescent-shaped deflection section 17, which opens eccentrically and axially in parallel into the first recess 6 of the gear assembly.

The fuel return line 26 located inside the support plate correspondingly comprises a second, crescent-shaped deflection section 18 joining the first recess 6. The second, crescent-shaped deflection section 18 is arranged offset in relation to the first deflection section in the front view of the first recess 6, and it is located especially nearly diametrically opposite.

The second crescent-shaped deflection section 18 passes over into a radial, second line section 19, which is closed radially on the outside, contains a fuel pressure regulator 20 and is in connection, via an oblique hole as well as a parallel hole to the second line section, with the second jacket opening 23, to which an outer fuel return line (not shown) is connected. The parallel hole has an overpressure protection means 30 in the form of a pressure relief valve and is in connection, radially on the inside, with the first line branch 16, which is the inner fuel suction line inside the burner during the operation of the fuel pump.

As can be seen, the fuel lines are short, there are practically no deflection points (especially compared with the state of the art using a separate fuel pump) and there are practically no inner sealing points. The first recess 6 is sealed by the fastened burner nozzle assembly 2, which is the "cover" of the first recess 6, which is under pressure during operation. Similarly, on the other axial side of the support plate, the flanged drive motor 11 is the "cover" of second recess 7 located there, and a distance plate may be provided.

Figure 4:
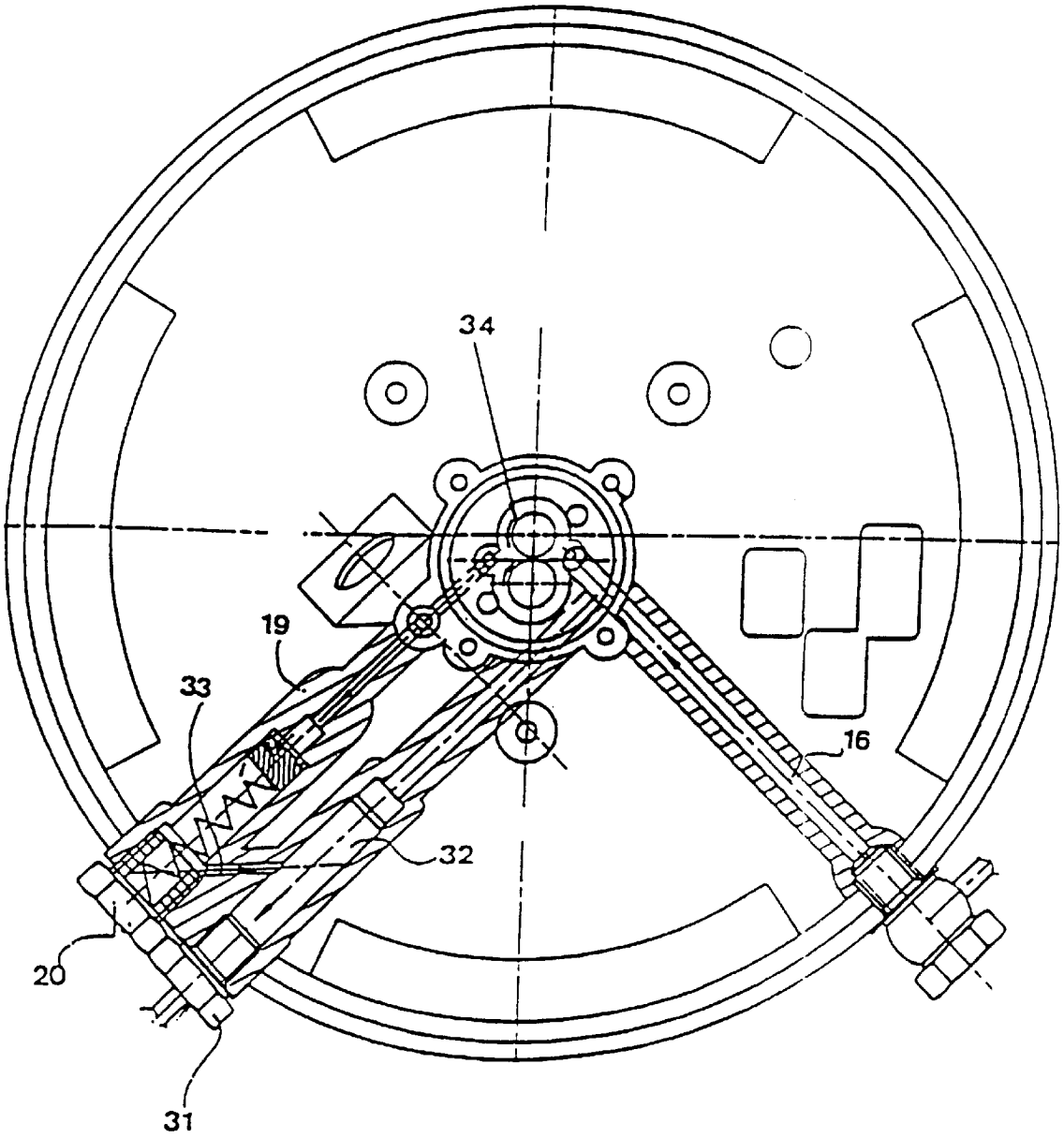
FIG. 4 is a front view similar to FIG. 2 of another design variant.

The exemplary embodiment shown in FIG. 4 is an atomizing burner 1, which is operated with a single strand on the fuel suction or feed side. In particular, the burner has no outer fuel return line, unlike the above-described exemplary embodiment. The jacket opening 23 is rather closed by a plug 31, and the second line section 19 is in connection with the first line section 16 via the oblique hole 33 and a line branch 32.

Contrary to the first exemplary embodiment, there is no overpressure protection means now in the line branch 32, which corresponds to the parallel hole of the first exemplary embodiment, so that excess fuel is again fed to the suction side of the fuel pump, corresponding to the setting of the fuel pressure regulator 20, without being discharged to the outside ("single-strand operation").

The plug 31 is a vent screw, which can be loosened completely or partially to vent the fuel pump and is easily accessible to an operator, optionally with an interposed extension tube in a plug-type connection to the second jacket opening 23, in which case the vent screw is arranged at the free end of the extension tube.

While specific embodiments of the invention have been shown and described in detail to illustrate the application of the principles of the invention, it will be understood that the invention may be embodied otherwise without departing from such principles.

What is claimed is:

1. An atomization burner for liquid fuel, the burner comprising:

a burner nozzle assembly including an atomization nozzle;

a fuel pump connected to said nozzle assembly and feeding fuel to said atomization nozzle;

a fuel line connected to said fuel pump and feeding fuel to said fuel pump;

a burner housing including a radial support plate connected to said atomization nozzle and said fuel pump, said radial support plate forming a pump housing around said fuel pump.

2. The atomizing burner in accordance with claim 1, further comprising: an ignition spark generator and a fuel regulator, wherein fastening points for fastening said ignition spark generator and said fuel pressure regulator are provided in said support plate.

3. The atomizing burner in accordance with claim 1, wherein said burner housing includes a housing jacket made in one piece with said support plate.

4. The atomizing burner in accordance with claim 1, wherein said burner housing is a cast part.

5. The atomizing burner in accordance with claim 1, wherein said fuel pump includes overpressure protection means for establishing a short circuit between a suction line and a return line when a return is closed.

6. The burner in accordance with claim 1, wherein:

said pump housing cylindrically surrounds said fuel pump and has a closed axial end formed by said support plate;

said nozzle assembly closes another axial end of said pump housing.

7. The burner in accordance with claim 1, wherein:

said pump housing cylindrically surrounds said fuel pump, said radial support plate and said pump housing are formed as a single homogeneous part.

8. The burner in accordance with claim 1, wherein:

said radial support plate includes a central base defining a gear recess on one axial side of said radial support plate;

said fuel pump is a gear driven fuel pump with a gear assembly arranged in said gear recess of said central base.

9. An atomizing burner in accordance with claim 8, further comprising fastening screws, said burner nozzle assembly being fastened on one axial side of said support plate by said fastening screws distributed over a circumference thereof, wherein said burner nozzle assembly covers said gear recess in a sealed manner.

10. An atomizing burner in accordance with claim 8, wherein:

said central base defines a coupling recess on another axial side of said support plate, and said support plate defines an axial passage;

said fuel pump includes a drive pinion connected to a drive shaft and a coupling connected to said drive shaft, said drive shaft being arranged in said axial passage, said coupling being arranged in said coupling recess.

11. The atomizing burner in accordance with claim 10, further comprising:

a fuel pump drive motor in drive connection with said coupling; and additional fastening screws fastened said drive motor, said fastening screws being distributed over a circumference of said another axial side of said support plate covering said coupling recess.

12. The atomizing burner in accordance with claim 10, wherein said drive shaft is mounted in said support plate in a slide bearing in a form of a bearing bush.

13. An atomizing burner in accordance with claim 10, further comprising: a rotary shaft seal arranged in an annular recess of said support plate for sealing said drive shaft at a coupling side.

14. An atomizing burner in accordance with claim 13, wherein said support plate has an eccentric channel provided between said rotary shaft seal and said gear recess.

15. An atomizing burner in accordance with claim 8, wherein:

said central base defines a coupling recess on another axial side of said support plate, and said central base defines an axial passage connecting said coupling and gear recesses;

said fuel pump includes a drive pinion of said gear assembly connected to a drive shaft and a coupling connected to said drive shaft, said drive shaft being arranged in said axial passage, said coupling being arranged in said coupling recess.

16. The burner in accordance with claim 8, wherein:

said support plate defines a first jacket opening and a fuel feed line leading from said first jacket opening to said gear recess, said support plate also defines a second jacket opening and a fuel return line leading from said second jacket opening to said gear recess.

17. The atomizing burner in accordance with claim 16, wherein said fuel feed line comprises a radial, first line section and, at a radially inner point, a first, crescent-shaped deflection section, which opens axially in parallel and eccentrically into said gear recess.

18. The atomizing burner in accordance with claim 16, wherein said fuel return line comprises a second, crescent-shaped deflection section, said second, crescent-shaped deflection section being offset in relation to said first crescent-shaped deflection section and being connected to said first recess axially in parallel and eccentrically and passing over into a radial, second line section, said radial second line section being in connection with said second jacket opening of said burner housing.

19. The atomizing burner in accordance with claim 18, wherein said fuel pump has means for single-strand operation with a plug in said second jacket opening or in an outer extension tube to said second jacket opening or in said first jacket opening or in a tube extension therefrom, wherein said first line section is connected to said second line section via a line branch.

20. The atomizing burner in accordance with claim 19, wherein said line branch is a parallel hole to said second line section, which contains said plug.

21. The atomizing burner in accordance with claim 19, wherein said plug is a vent screw.

22. An atomization burner for liquid fuel, the burner comprising:

a burner nozzle assembly including an atomization nozzle;

a fuel pump connected to said nozzle assembly and feeding fuel to said atomization nozzle;

a fuel line connected to said fuel pump and feeding fuel to said fuel pump;

a burner housing including a radial support plate connected to said atomization nozzle and said fuel pump, said radial support plate defines a first jacket opening and a fuel feed line leading from said first jacket opening to said fuel pump, said support plate also defines a second jacket opening and a fuel return line leading from said second jacket opening to said fuel pump.

* * * * *